US009016484B2

(12) United States Patent
Kologe

(10) Patent No.: US 9,016,484 B2
(45) Date of Patent: Apr. 28, 2015

(54) DISPLAY TRAY AND BAR, AND MOUNTING BRACKET THEREFOR

(75) Inventor: Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 205 days.

(21) Appl. No.: 13/525,542

(22) Filed: Jun. 18, 2012

(65) Prior Publication Data

US 2012/0255924 A1 Oct. 11, 2012

Related U.S. Application Data

(63) Continuation-in-part of application No. 12/354,398, filed on Jan. 15, 2009, now Pat. No. 8,210,367.

(60) Provisional application No. 61/530,798, filed on Sep. 2, 2011.

(51) Int. Cl.

| | |
|---|---|
| ***A47F 5/08*** | (2006.01) |
| ***A47F 1/12*** | (2006.01) |
| ***A47F 3/14*** | (2006.01) |
| ***A47F 5/00*** | (2006.01) |
| *A47F 5/10* | (2006.01) |

(52) U.S. Cl.

CPC . *A47F 1/125* (2013.01); *A47F 3/14* (2013.01); *A47F 5/0025* (2013.01); *A47F 5/0838* (2013.01); *A47F 5/101* (2013.01)

(58) Field of Classification Search

CPC ..... A47F 1/12; A47F 1/121; A47F 1/123; A47F 1/125; A47F 1/126; A47F 1/128

USPC ..... 211/51, 59.2, 59.3, 88.01, 126.15, 211/133.6; 221/56, 198, 226, 279; 108/61, 108/108; 248/340, 214, 215

See application file for complete search history.

(56) References Cited

U.S. PATENT DOCUMENTS

| | | | | | |
|---|---|---|---|---|---|
| 451,270 | A | * | 4/1891 | Elten | 248/215 |
| 782,738 | A | * | 2/1905 | Faust | 248/215 |
| 1,068,391 | A | * | 7/1913 | Jensen | 248/214 |
| 2,665,869 | A | * | 1/1954 | Samuels | 248/214 |
| 2,845,187 | A | | 7/1958 | Bianchi | |
| 3,161,295 | A | * | 12/1964 | Chesley | 211/59.3 |
| 3,248,079 | A | | 4/1966 | Kennedy | |
| 4,316,546 | A | | 2/1982 | Varon et al. | |
| 4,316,547 | A | | 2/1982 | Varon | |
| 4,449,686 | A | * | 5/1984 | Kersey | 248/215 |

(Continued)

*Primary Examiner* — Jonathan Liu

*Assistant Examiner* — Stanton L Krycinski

(74) *Attorney, Agent, or Firm* — St. Onge Steward Johnston & Reens LLC

(57) ABSTRACT

A product display tray and associated mounting bar and bracket. The mounting bar and bracket are configured to minimize space occupied in a front to back direction and enable mounting of a tray in a manner to maximize the number of products displayed. The mounting brackets allow the bar to be turned end for end to adjust the vertical position of the bar by one-half spacing in order to maximize vertical density of the packaging display. The tray has specially configured, rearwardly opening recesses at its back edge to receive the mounting bar while allowing a base of the tray to extend underneath and behind the bar. The tray, bar and brackets are also uniquely designed to enable a tray to be mounted on two adjacent, aligned mounting bars, to maximize horizontal density of the packaging display. Other disclosed features enhance the usefulness and efficiency of the display.

16 Claims, 10 Drawing Sheets

(56) References Cited

U.S. PATENT DOCUMENTS

| | | | | |
|---|---|---|---|---|
| 4,474,299 | A | 10/1984 | Andrews | |
| 4,831,673 | A * | 5/1989 | Winckler | 5/503.1 |
| 5,133,463 | A | 7/1992 | Merl | |
| 5,366,099 | A | 11/1994 | Schmid | |
| 5,454,638 | A * | 10/1995 | Bird et al. | 312/408 |
| 5,582,376 | A | 12/1996 | Thompson | |
| 5,665,304 | A | 9/1997 | Heinen et al. | |
| 5,855,283 | A | 1/1999 | Johnson | |
| 6,029,833 | A | 2/2000 | Yeh | |
| 6,378,828 | B1 * | 4/2002 | Valiulis et al. | 248/231.81 |
| 6,402,108 | B1 | 6/2002 | Remmers | |
| 6,467,743 | B1 * | 10/2002 | Shiojima | 248/214 |
| 6,641,098 | B1 | 11/2003 | Proffitt | |
| 6,672,226 | B2 * | 1/2004 | Bohnacker | 108/108 |
| 6,745,906 | B1 | 6/2004 | Nagel | |
| 6,866,155 | B2 * | 3/2005 | Nagel | 211/59.3 |
| 6,866,156 | B2 * | 3/2005 | Nagel et al. | 211/59.3 |
| 6,886,700 | B2 * | 5/2005 | Nagel | 211/59.3 |
| 6,889,855 | B2 * | 5/2005 | Nagel | 211/59.3 |
| 7,458,473 | B1 | 12/2008 | Mason | |
| 7,681,744 | B2 | 3/2010 | Johnson | |
| 7,690,519 | B2 | 4/2010 | Kahl et al. | |
| 2004/0000528 | A1 * | 1/2004 | Nagel | 211/59.3 |
| 2004/0004047 | A1 * | 1/2004 | Nagel et al. | 211/59.3 |
| 2004/0065631 | A1 * | 4/2004 | Nagel | 211/59.3 |
| 2004/0084392 | A1 * | 5/2004 | Richter et al. | 211/59.3 |
| 2004/0173546 | A1 * | 9/2004 | Nagel | 211/59.3 |
| 2005/0092702 | A1 * | 5/2005 | Nagel | 211/59.3 |
| 2005/0178789 | A1 * | 8/2005 | Lavery | 221/241 |
| 2006/0186065 | A1 * | 8/2006 | Ciesick | 211/59.3 |
| 2006/0213849 | A1 | 9/2006 | Bienick | |
| 2007/0170127 | A1 * | 7/2007 | Johnson | 211/59.3 |
| 2008/0035589 | A1 * | 2/2008 | Rasmussen et al. | 211/59.3 |

* cited by examiner

DISPLAY TRAY AND BAR, AND MOUNTING BRACKET THEREFOR

CROSS-REFERENCE TO RELATED APPLICATIONS

The present application claims the benefit under 35 U.S.C. §119(e) of the U.S. Provisional Patent Application Ser. No. 61/530,798, filed on Sep. 2, 2011. The present application is also a continuation-in-part of U.S. patent application Ser. No. 12/354,398, filed Jan. 15, 2009 (now U.S. Pat. No. 8,210,367, granted Jul. 3, 2012) and claims the priority thereof. All prior applications are herein incorporated by reference in their entirety.

FIELD OF THE INVENTION

The invention is directed to an improved form of cantilever-mounted product display tray for the forward presentation of products for customer selection, and to an improved form of mounting bar and bracket for mounting and supporting such trays.

BACKGROUND OF THE INVENTION

The display of pre-packaged food and other products commonly involves the use of adjustable width trays with spring-driven pushers for moving a column of packages forward as items are removed from the front of the tray. Adjustable side guides are provided for confining the packages in a desired column form as individual packages are withdrawn from the display. A critically important aspect of such package displays is the ability of maximize the number of such display trays in a given display area and also to maximize the effective length of the tray to enable stocking with as many packages as possible. This is especially true where the display trays are mounted in a fully confined space such as coolers with front walls or doors. The above-mentioned application Ser. No. 12/354,498 discloses a novel form of display tray that represents a significant improvement over earlier trays in, among other things, utilizing its adjustable side guides to provide cantilever mounting of the tray on a display bar. Notwithstanding the benefits and advantages of the above described tray, there is still room for improvement in further optimizing the space efficiency of the tray and its supporting means.

SUMMARY OF THE INVENTION

In accordance with one aspect of the present invention, an improved form of mounting bar and bracket is provided which, in conjunction with improved design of mounting arrangements for the tray, enables a significantly greater utilization of available display space in a store, allowing the storekeeper to optimize product display and, as a result, achieve greater sales. The new mounting bar, which is of a rigid tubular construction, is formed with a cross section of substantially greater height than width, for example, greater than two to one, and with specially constructed mounting brackets by which the bar is mounted to vertical uprights of a merchandising gondola, or display.

An advantageous feature of the bar-mounting brackets is the provision thereon of two sets of upright-engaging hook portions arranged to support a bar in different position with respect to hook-engaging slots on the vertical uprights. In one preferred embodiment of the invention, one of the hook portions is located on the upper front edge of the bracket and the other is on the upper back edge thereof. The two hook portions are offset vertically by one-half the distance between slots on the uprights. A typical slot spacing on the uprights is one inch, in which case the vertical offset between the two hooks portions on the brackets would be one-half inch. The mounting brackets are permanently or semi-permanently retained on the bar by end caps or other stops. By reversing the bar end for end, the bracket hooks are reversed such that the bar can be repositioned vertically with respect to the existing slots by one-half the distance between slots. This gives the merchandiser a much greater flexibility in the positioning of the trays and enables maximum vertical density of trays on the display wall or rack to be realized.

In accordance with another aspect of the invention, the display tray is constructed with side walls formed with specially configured, rearwardly opening recesses for the reception of a mounting bar of vertically elongated cross section. The recesses are of a somewhat inverted J-shaped configuration, with a rearwardly opening entrance portion at the rear edge of each side wall large enough to receive the height of the vertically elongated mounting bar and with a downwardly opening, bar-engaging portion to receive and lockingly engage the mounting bar at an extreme rear portion of the side walls. The tray includes a bottom platform, formed largely of longitudinally extending rods which slideably support a spring driven pusher. Pursuant to the invention, the bottom platform extends to a back extremity of the tray, and the bar-receiving recesses are located high enough in the side walls to permit the bottom platform to extend underneath a mounting bar on which the tray is supported. The positioning and arrangement of the inverted J-shaped and rearwardly opening recesses at the back of the side walls, together with the narrow cross section of the mounting bar, allows the bottom platform to be extended underneath the mounting bar and the pusher to be retracted much farther to the rear of the tray than with trays and mountings of conventional construction. This increases the number of packages that can be stocked in a tray of given length. For example, the new construction enables as much as 1 ½ inches of additional, usable product space to be realized in a tray, within a given limited amount of front-to-back display space, as in closed coolers, for example.

The tray-mounting arrangement described above, by enabling the bottom platform of the tray to extend underneath the mounting bar, also allows the mounting bar to serve as a rigid backstop for the pusher paddle. This facilitates and expedites positioning of the paddles for tray loading operations and minimizes wear and damage to the paddles.

In accordance with another aspect of the invention, certain modifications of the cantilever mounted display tray may be formed with side walls having inwardly offset bar-engaging portions. The arrangement is such that the one of the product-confining side walls of a tray may overlap part or all of the vertical upright on which its mounting bar is supported, while the bar-engaging portion of the side wall is offset along the inside of the vertical upright. This arrangement enables a greater horizontal density of trays to be achieved.

For a more complete understanding of the features and advantages of the invention, reference should be made to the following detailed description of preferred embodiments and to the accompanying drawings.

DETAILED DESCRIPTION OF THE INVENTION

Figure 1:
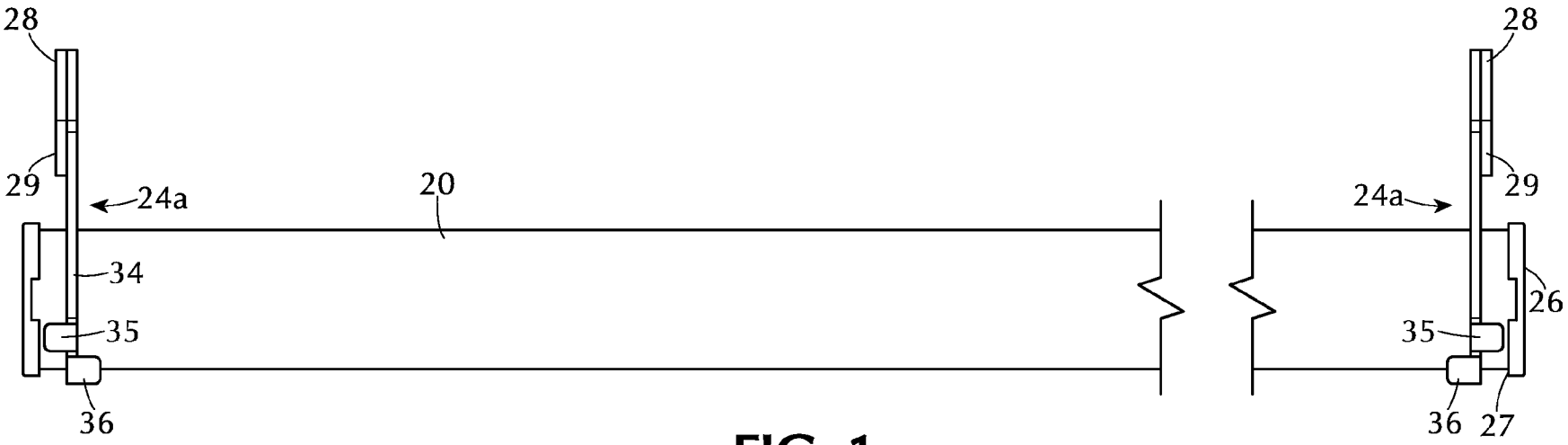
FIGS. 1 and 2 are front elevation and top plan views respectively of a mounting bar and brackets according to one aspect of the invention.

Referring to the drawings, and initially to FIGS. 1-6 thereof, the reference numeral 20 designates a tubular steel display mounting bar which is of generally rectangular cross section and has a cross sectional height which is greater than its cross sectional width by a factor of at least two. In one advantageous form of the invention the tubular steel bar has a height of about 1.25 inches and a width of about one-half inch. A typical such display mounting bar has a length of about 48 inches, which is consistent with the width of a typical gondola, refrigerated display section, or the like. Such a display structure is provided with pairs of laterally spaced apart uprights, such as shown at 21 in FIGS. 3 and 4. The uprights 21 are provided with vertically spaced slots 22, typically formed with one inch spacing, separated by cross elements 23 by which external elements, such as the mounting brackets 24, are engaged and supported.

Figure 6:
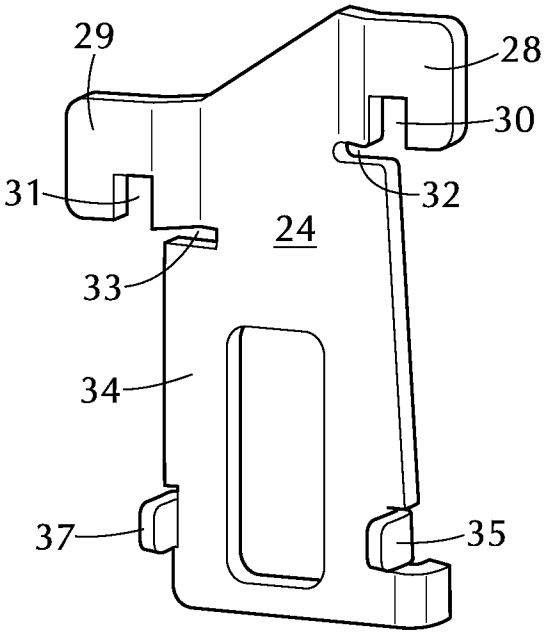
FIG. 6 is a front orthographic view of an improved form of mounting bracket shown in FIGS. 1 and 2.
Figure 5:
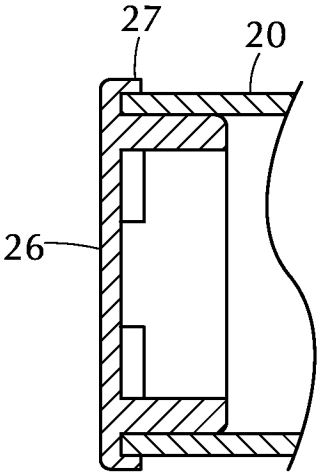
FIG. 5 is an enlarged, fragmentary cross sectional view of one end of a mounting bar with a retainer cap installed thereon.

Each display mounting bar 20 is engaged by a pair of the mounting brackets 24, 24*a*, bracket 24 being shown best in FIG. 6. The mounting brackets 24, 24*a* are formed with openings 25 closely conforming to the generally rectangular external cross section of the tubular bar 20. Enough clearance is provided, however, to enable the brackets to be slideable along the bar to adjust for typical spacing differences between pairs of uprights 21. End caps 26, which may be formed of a durable plastic material, are tightly received in opposite ends of the display mounting bar 20 and serve to effectively permanently retain the mounting brackets on the bar 20. To advantage, the end caps have outer flange portions 27 which extend a short distance inward from end extremities of the bar in order to space the brackets 24, 24*a* a minimum distance inward from such end extremities. Any suitable obstruction-forming means may be employed to retain the brackets on the bar 20, and retain them at least slightly (e.g., $1/16^{th}$ inch) inward of the end extremities of the bar.

The mounting brackets 24, 24*a* at opposite ends of the bar 20 are of identical construction except that upright-engaging hook portions thereof are displaced laterally in opposite directions. As shown in FIG. 6, the mounting bracket 24 comprises a stamping of stiff sheet metal, with the opening 25 located near the bottom thereof and upper and lower hook portions 28, 29 at the top of the bracket, on opposite (front and back) edges thereof. In accordance with an aspect of the invention, the opening 25 is located as close as practicable to the bottom edge of the bracket (e.g., less than $1/8^{th}$ inch above), in order to maximize clearance space below the bracket and, in appropriate circumstances, enable portions of a mounted display tray to extend underneath the brackets.

Figure 4:
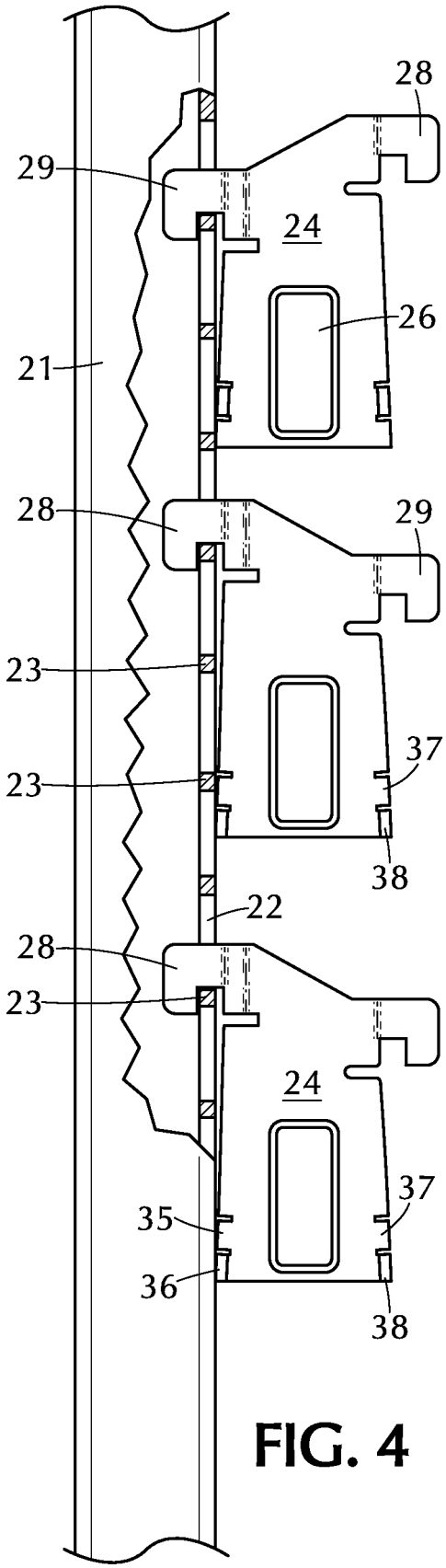
FIG. 4 is a side elevational view, with parts broken away of the arrangement of FIG. 3.

As shown in FIGS. 6 and 4, the hook portions 28, 29 are formed with downwardly opening slots 30, 31 of a width somewhat greater than the wall thickness of the uprights 21, such that the hooks can be received in the slots 22 of the uprights and engaged with the cross elements 23 as shown in FIG. 4. Horizontal slots 32, 33 are formed in the flat body portion 34 of the bracket 24 to accommodate laterally outward displacement of the hook portions 28, 29 as is evident in FIG. 6. The outward displacement of the hook portions corresponds generally with the distance from the end surface of the end cap 26 (FIG. 5) to the inner edge 27*a* of the end cap flange 27, such that the hook portions can align generally with the capped ends of the display mounting bar 20, while the body portions 34 of the brackets are displaced laterally inwardly thereof to lie inward of the cap flange edges 27*a*.

Figure 2:
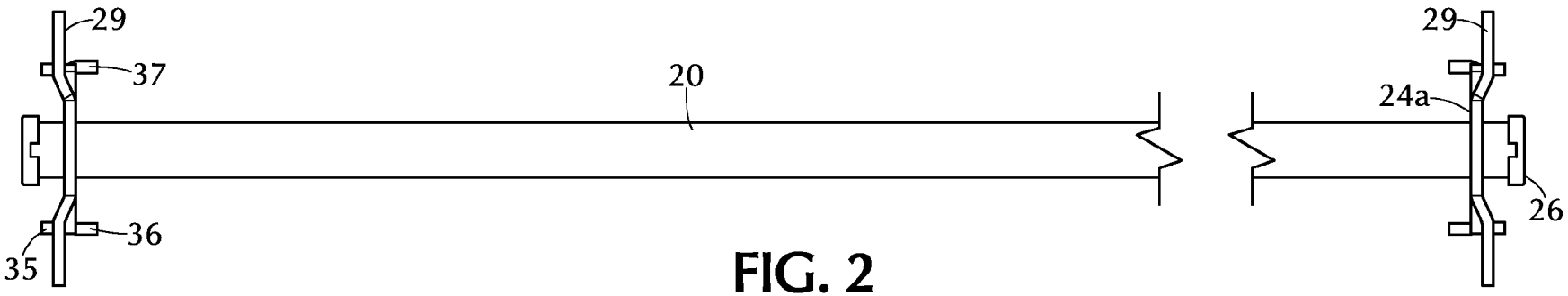

As will be understood, the displacement of hook portions of a brackets 24, 24*a*, at the opposite ends of the mounting bar 20, will be in opposite directions in order that the hook portions are displaced laterally outward at the opposite ends of the bar (see FIG. 2). In other respects the two brackets 24, 24*a* of each pair are the same.

In accordance with an aspect of the invention, the upper hook portion 28 and slot 30 are spaced above the lower hook portion 29 and slot 31 by a distance corresponding to one-half the spacing between slots 22 of the uprights 21. As a result, the storekeeper is not limited to adjusting spacing between display mounting bars 20 in increments of the one inch slot spacing. By turning a mounting bar end for end, the brackets 24, 24*a* will be re-oriented, with a different set of hooks presented to the uprights. As shown in FIG. 4, in the two upper tiers of brackets, the upper set is engaged by its lower hook portions 29 while the set below is engaged by its upper hook portions 28. Accordingly, the bar spacing between the first two tiers of FIG. 4 is three and one-half inches, while the spacing between the second the third tiers, with the mounting brackets 24 oriented to present the upper hook portions 28 in both instances, is four inches. This one-half inch adjustability gives the store operator a very important advantage in optimizing the number of vertical facings (number of displays) in a given available vertical height of the display. In this respect, an accumulation of several one-half inch space savings can quickly enable an additional product facing to be realized. On occasion, as little as a single one-half inch space saving may be enough to enable the store operator to insert an additional row of trays. Such additional facings are extremely important to the economic returns realized by the store operator, as will be readily understood.

As indicated in FIG. 4, the body portions 34 of the mounting brackets 24 are tapered slightly in a vertical direction, being somewhat narrower adjacent the top than at the bottom. At the bottom of the bracket body, at front and back edges thereof, there are tabs bent laterally outward to form pairs of pressure pads 35, 36 and 37, 38. When the brackets 24 are engaged with the uprights 21, the pair of pressure pads spaced below the engaged hook portions will bear against the front face of the upright 21 and distribute the force of the rotational loading applied by a display mounting bar 20 on which several fully loaded trays may be mounted in cantilever fashion.

Figure 7:
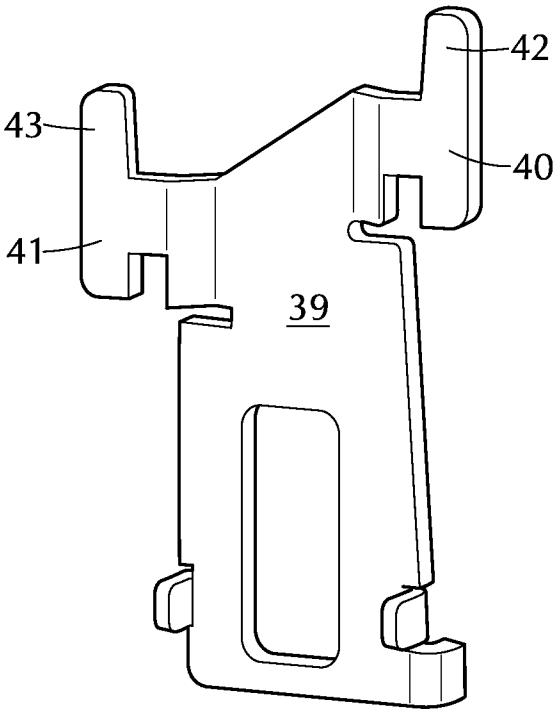
FIG. 7 is an orthographic view of a modified form of mounting bracket which optionally can be used with the mounting bar arrangement of the invention.

A modified form of mounting bracket 39, shown in FIG. 7, has the same construction and attributes as the brackets 24, 24*a* previously described except that the respective hook portions 40, 41 are formed with upward extensions 42, 43. The arrangement is such that the total height of the hook portions 40, 41, together with the upward extensions 42, 43 is at least slightly greater than the height of the slots 22 in the uprights 21. In order to insert or remove the hook portions, the brackets have to be tilted somewhat, and in order to remove the brackets they must be both lifted and tilted. This prevents any accidental dislodgment of the brackets from uprights in which they are installed.

In the illustrated form of the invention, the bar-mounting brackets 24, 24*a* are formed in such manner that the vertical edges of the bar opening 25 lie on axes spaced very close to the respective downwardly opening slots. Preferably, the spacing between an inside edge of the slot 31 (FIG. 6) and the nearby vertical edge of the bar opening 25 is less than one-half inch and more particularly about 0.40 inch. The same relationship is provided between the inside edge of the slot 30 and the vertical edge of the bar opening that is nearest thereto. This geometry enables the display mounting bar 20 to be positioned as close as practicable to the fronts of the vertical uprights and thus allows the back ends of display trays mounted thereon to be positioned as far back in the display structure as is feasible. This in turn enables more product packages to be displayed in a given confined front-to-back space.

Referring now to FIGS. 8-12 there is shown an improved form of cantilever supported, adjustable width tray in which the tray is supported by its adjustable width side walls. This incorporates many of the principles of the before mentioned U.S. Pat. No. 8,210,367 but also includes certain important improvements. These improvements, as will be described, enable significant benefits to the storekeeper as regards optimizing the amount of product that can be displayed for sale and facilitating the ability of the storekeeper to organize, manage and maintain a display of various products attractively presented and in the greatest possible density, in order to achieve the greatest sales results and the greatest return on investment.

The new tray comprises a bottom platform 50 formed by a plurality of longitudinally extending, laterally spaced apart wire rods 51 secured in spaced, parallel relation by cross rods 52, 53, which are welded underneath the longitudinal rods 51. The cross rods 52, 53 are snap fit into upwardly opening transverse grooves formed in front and back plastic base members 54, 55. Reference may be made to U.S. Pat. No. 6,866,155, the content of which is incorporated herein by reference, with regard to certain principles of construction of the bottom platform 50.

Figure 9:
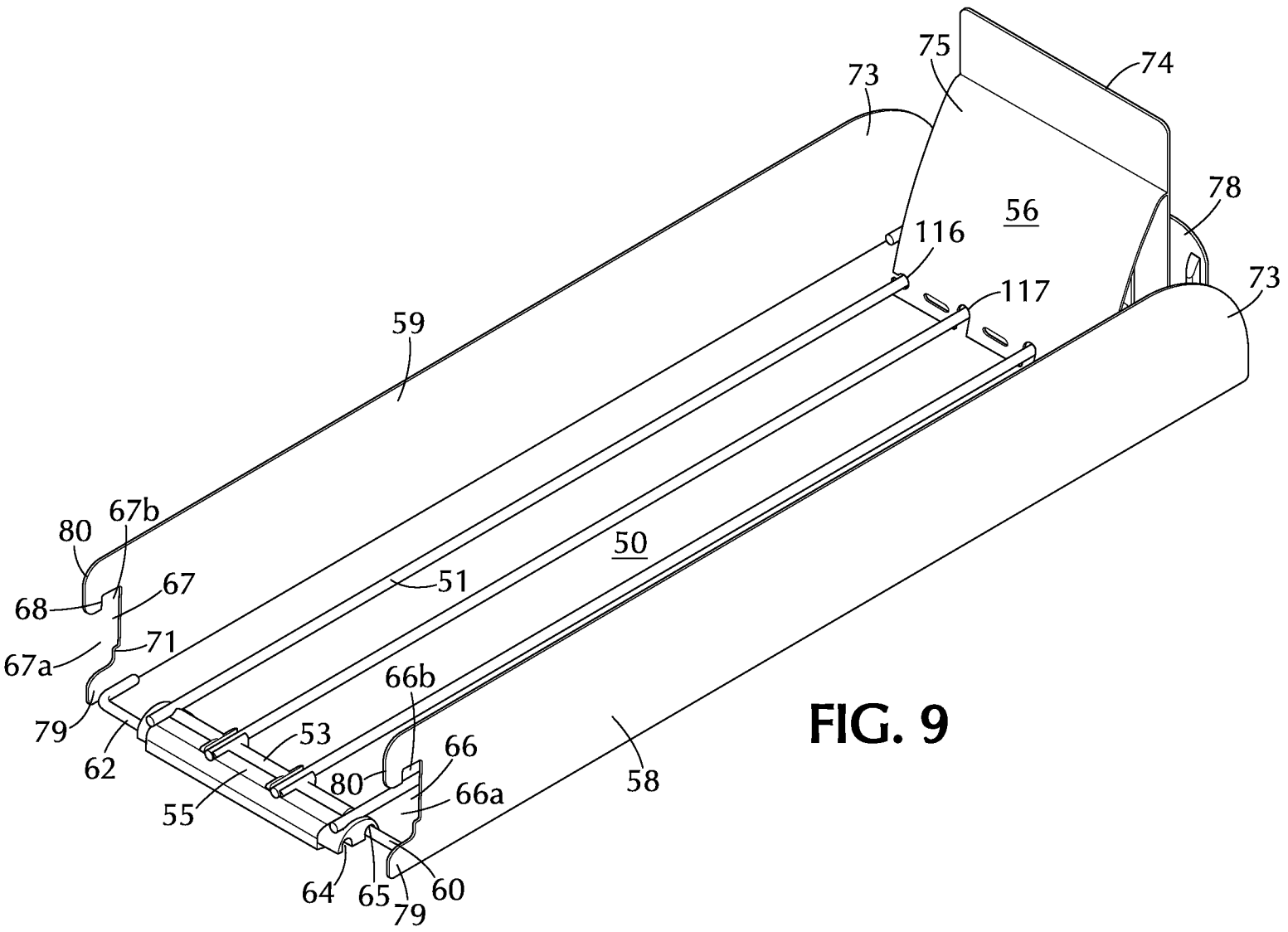
FIG. 9 is a rear orthographic view of the tray of FIG. 7.

A plastic pusher paddle 56, which may be of a generally inverted "Y" configuration, is slideably mounted on the longitudinal rods 51 and is urged forwardly by one or more coiled strip springs 57. Side walls 58, 59, best formed of stiff sheet metal, are positioned on each side of the base. Each side wall has front and back transversely disposed wire rods 60, 61 and 62, 63 welded thereto and extending inward for tight but slideable reception in transverse passages 64, 65 (FIG. 9). The side walls 58, 59 are thus adjustable laterally inward and outward with respect to the base members 54, 55 in order to accommodate product packages of different widths.

The illustrated form of pusher paddle 56 advantageously is of extruded plastic construction and comprises a front panel 74 positioned to engage the back most package of a column of packages. A back panel 75 joins integrally with the front panel 74, typically somewhat below the upper edge of the front panel, and extends downward and rearward therefrom. At least the back panel 75 is somewhat flexible. Both panels 74 and 75 are provided with rod-receiving notches 76, 77 adjacent their bottom edges. Typically the notches 76 at the side edges are horizontally oriented and laterally opening, while the notches 77 in the mid portions of the panels are vertically oriented and downwardly opening. The arrangement is such that, once the paddle 56 is installed on the rods 51 it is securely retained thereon while being easily slidable. The coiled springs 57, of which there may be one or more depending on the weight of the packages to be displayed, urge he paddle, and the packages positioned in front of the panel 74, forward toward a barrier panel 78 mounted at the forward end of the bottom platform 50.

In accordance with an aspect of the invention, the side walls 58, 59 are formed at their respective back ends with rearwardly opening bar-receiving recesses 66, 67. The recesses are of a size and shape to closely receive the display mounting bars 20, such that the trays can be supported in cantilever fashion, in the manner indicated in FIGS. 8 and 10. The recesses 66, 67 have two main portions, rearwardly opening entrance portions 66*a*, 67*a*, and inner, downwardly opening bar engaging portions 66*b*, 67*b*. The entrance portions 66*a*, 67*a* are of sufficient height to receive the full height of the bar 20 as a tray is moved rearward during installation. In the illustrated form of the invention, the inner recess portions 66*b*, 67*b* include spaced apart, downwardly extending edge portions 68, 69 (FIGS. 9, 10), engageable respectively with upper back surface portions and lower front surface portions of the display mounting bar 20. Upper edge portions 70 of the recesses are engageable with the top surface of the mounting bar. In addition, a short rearward projection 71 extends closely underneath a front lower surface portion of the display mounting bar and serves to prevent accidental vertical dislodgement of a tray after the tray has been mounted on the bar 20. The several bar-engaging portions 68-71 are arranged to provide a slight clearance about the bar 20, such that the tray can be tilted slightly upward at the forward end thereof when the tray is being installed on the mounting bar. The forward end can then be lowered to the position and orientation shown in FIG. 10.

Figure 10:
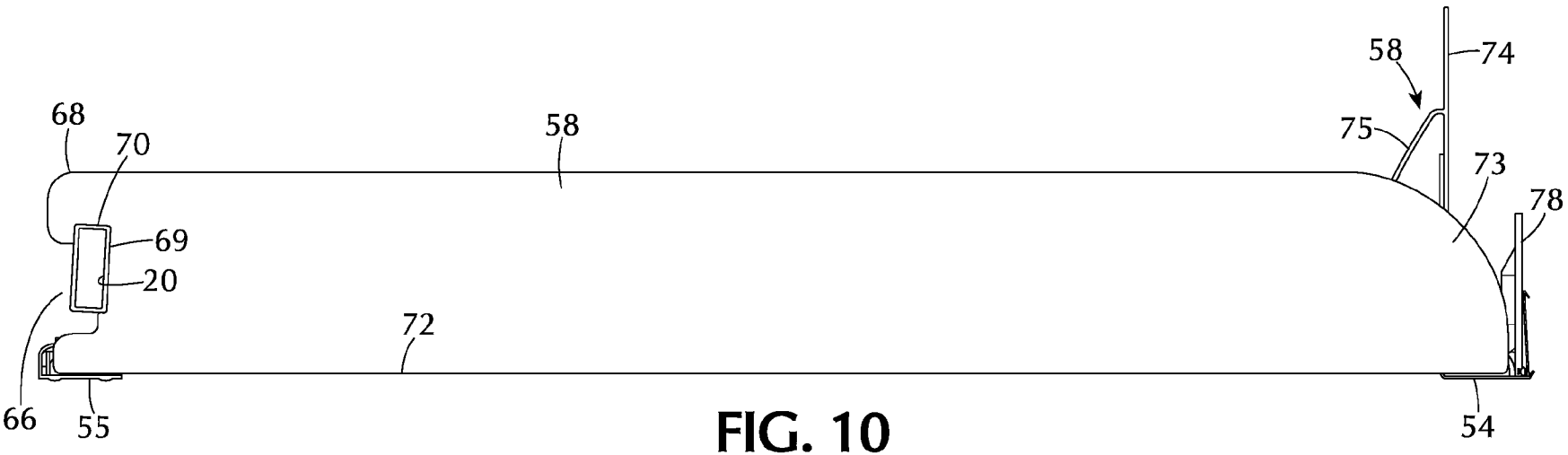
FIGS. 10 and 11 are side elevational and top plan views respectively of the tray of FIG. 8.
Figure 11:
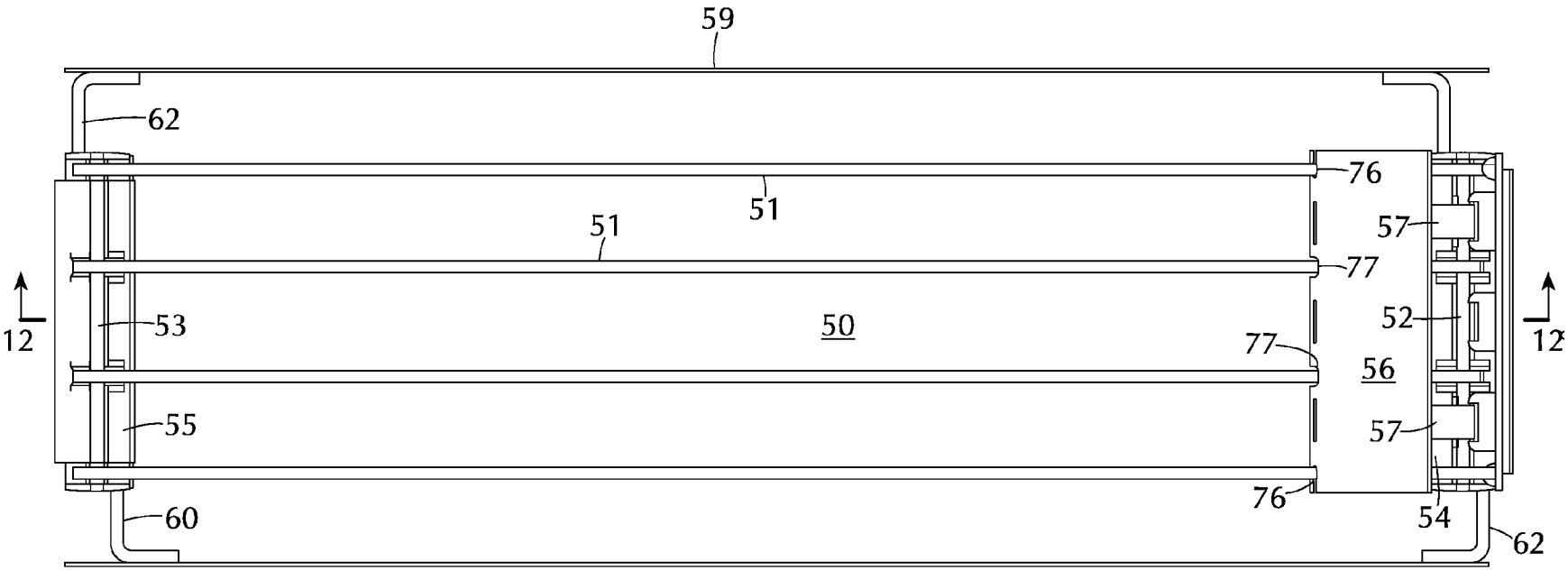
Figure 12:
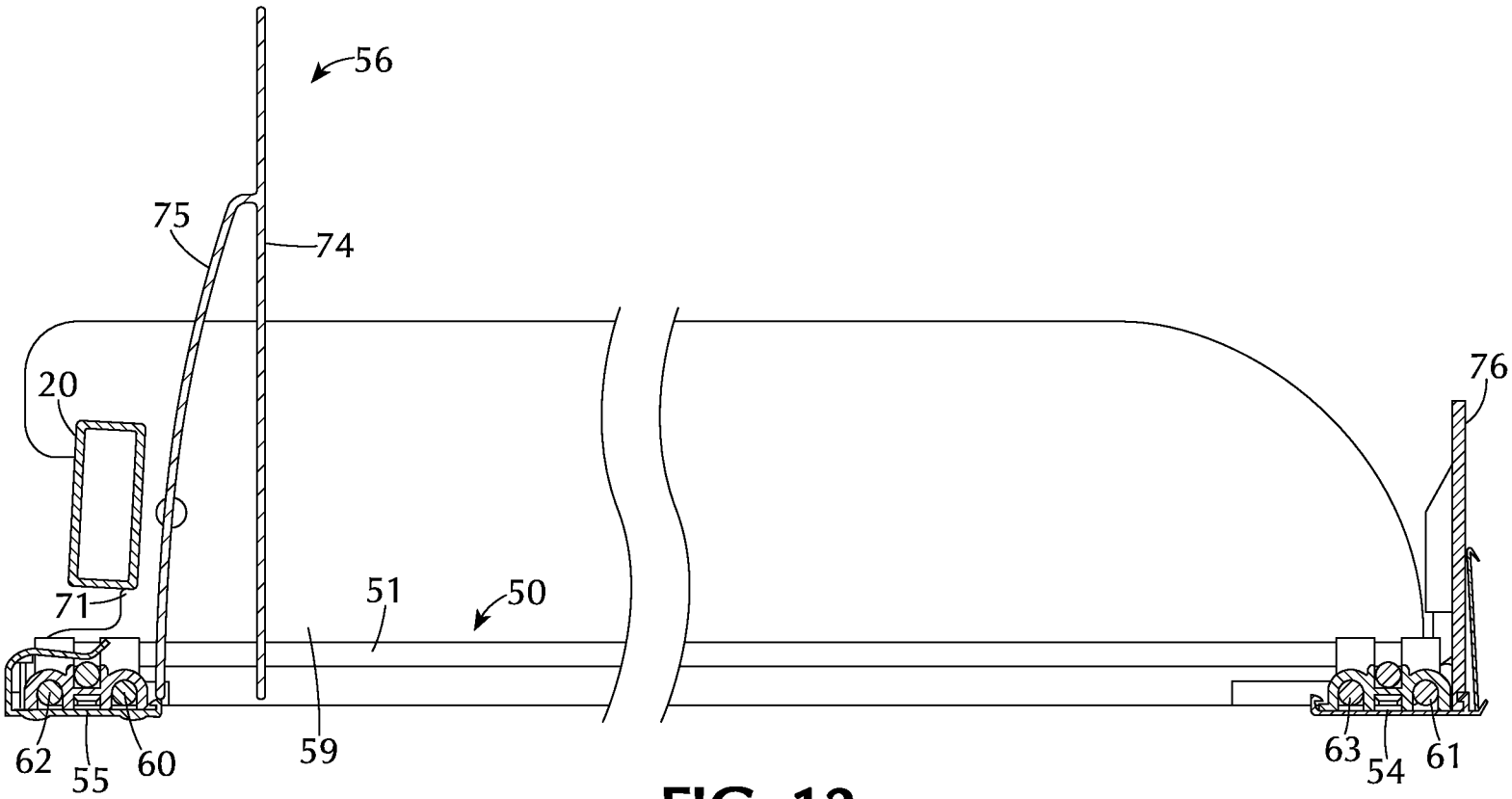
FIG. 12 is a cross sectional view as taken generally along line 12-12 of FIG. 11.

As shown in FIGS. 10 and 12, the rearwardly opening recesses 66, 67 for receiving the display mounting bar 20 are located well above the bottom edges 72 of the tray side walls 58, 59. This allows the rear base member 55 to be positioned at the back extremity of the tray side walls and enables the rods 51 of the bottom platform 50 to extend underneath the bar 20 when the tray is mounted thereon. This arrangement enables the pusher 56 to be moved substantially farther to the rear during re-loading of the tray than with trays of earlier design (see FIG. 12) and assures that a maximum number of product packages can be loaded into the tray. In a practical embodiment of the present invention, it is possible to gain as much as 1½ inches of additional package holding space in a tray, as compared to prior tray constructions, which is highly beneficial to the store operator.

When loading a tray with product packages, the pusher 56 is pushed to the rear as far as possible and preferably is held is its retracted position by mechanical means that will allow the store clerk to use both hands for the loading operations. To advantage, a locking mechanism, such as that disclosed in the Joseph F. Kologe U.S. patent application Ser. No. 13/360,170, filed Jan. 27, 2012, can be employed to lock the pusher in a fully retracted position while packages are loaded into the tray. The content of said application Ser. No. 13/360,170 is hereby incorporated herein by reference.

With the construction of the invention, when the pusher 56 is moved toward a fully retracted position in its tray for loading, the lower edge of the back panel 75 typically will make initial contact with the back base element 55. Further retraction of the paddle will cause the back panel 75 to flex as the lower edge of the front panel 74 continues moving toward the lower edge of the back panel, until the two lower edges are quite close together, as shown in FIG. 12. Importantly, when the tray is being loaded while mounted on a display mounting bar 20, when the paddle 56 is pushed to a fully retracted position, the front surface of the display mounting bar 20, which is spaced slightly behind the front edge of the back base member 55, is positioned to engage the back panel 75 and form a rigid back stop for the paddle 56. This prevents excessive displacement of upper portions of the paddle after lower edges thereof have been stopped by the base member 55. This is especially useful for re-loading of a tray while mounted in a densely configured display among other trays in close proximity on all sides, where it may be difficult for the store clerk to visually observe the position of a retracted pusher paddle. The positive back stop of the display mounting bar 20 effectively prevents damage to the pusher paddle from over retraction thereof after the paddle has engaged the base member 55.

An additional and significant advantage of the tray configuration of the invention, in which the bottom platform 50 extends to the back extremity of the tray side walls, is realized when the tray is mounted on a shelf instead of on a bar. Store operators desire at all times to be able to load the maximum possible number of product packages into their display trays. Heretofore, store operators have frequently felt the need to utilize trays of different construction for shelf mounting than for bar mounting, in order to be able to use the full length of the tray. As will be understood, this adds both cost and inventorying issues with respect to management of the trays. With the trays of the invention, in which the base platform 50 extends the full length of the side walls 58, 59, the same trays can be used for bar mounting or for shelf mounting while still enabling the store operator to maximize product display in the shelf mounted trays. In this respect, as shown in FIGS. 10 and 12, the bottoms of the base members 54, 55 project slightly below the bottom edges 72 of the tray side walls, such that the tray is supported by its base members when placed on a shelf.

In a preferred and illustrated embodiment of the invention, lower rear portions 79 of the sidewalls 58, 59 extend completely under the bar-receiving recesses 66, 67 and lie directly below the upper rear extremities 80 of the side walls (FIG. 9). This enables the rear platform base 55 to be securely fixed in position at the back extremities of the tray.

Figure 8:
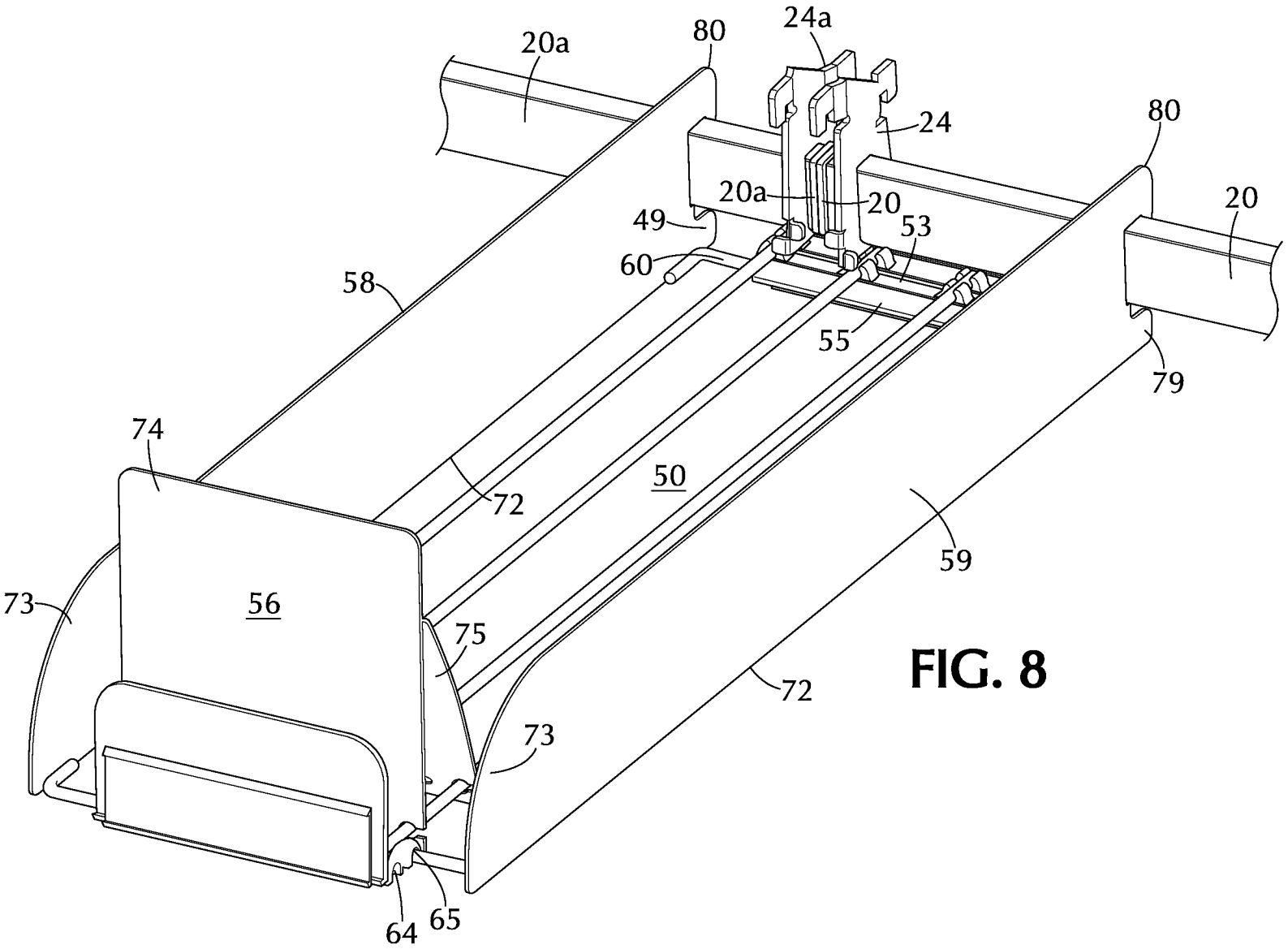
FIG. 8 is an orthographic view of an improved form of merchandise display tray which can be utilized to advantage in conjunction with the mounting bar and brackets of FIGS. 1-6.

Yet another significant advantage of the invention is derived from a combination of tray wall configuration and mounting bracket configuration which makes it feasible to mount a tray partly on one mounting bar 20 and partly on another bar 20*a* aligned therewith, as shown in FIG. 8. FIG. 8 shows two mounting bars 20, 20*a* as if mounted on side-by-side uprights (not shown) by means of a pair of mounting brackets 24, 24*a*. Such side-by-side positioning of uprights is typical in large displays where adjacent gondola or display panels are positioned in closely spaced, side-by-side relation. Pursuant to the invention, the location of the bar-receiving opening 25 as low as practicable in the mounting brackets 24, 24*a* and the elevation of the side wall recesses 66, 67 in the tray walls, enables the back extremities of the tray bases to be received underneath the bottoms of the mounting brackets, in the manner shown in FIG. 8. The ability to mount the new trays in straddling relation to a pair of mounting bracket, partly supported by each of two adjacent mounting bars 20, 20*a* is an important advantage to the storekeeper in that it can provide an opportunity to install an extra tray, horizontally, to help the store operator to maximize the horizontal density of the display and thus optimize the sales potential of a given display.

The forward portions of the illustrated trays can be of generally conventional and known construction. To advantage, however, the forward edge portions 73 are rounded off on a large radius equal to a substantial portion of the height of the side walls. For example, in a tray with side walls of about three inches in height, the radius of curvature of the front upper corners may be about 2¼ inches. This provides a more open-looking display, because the side walls less visible in the overall view, and also provides greater visual access to the front packages.

Figure 3:
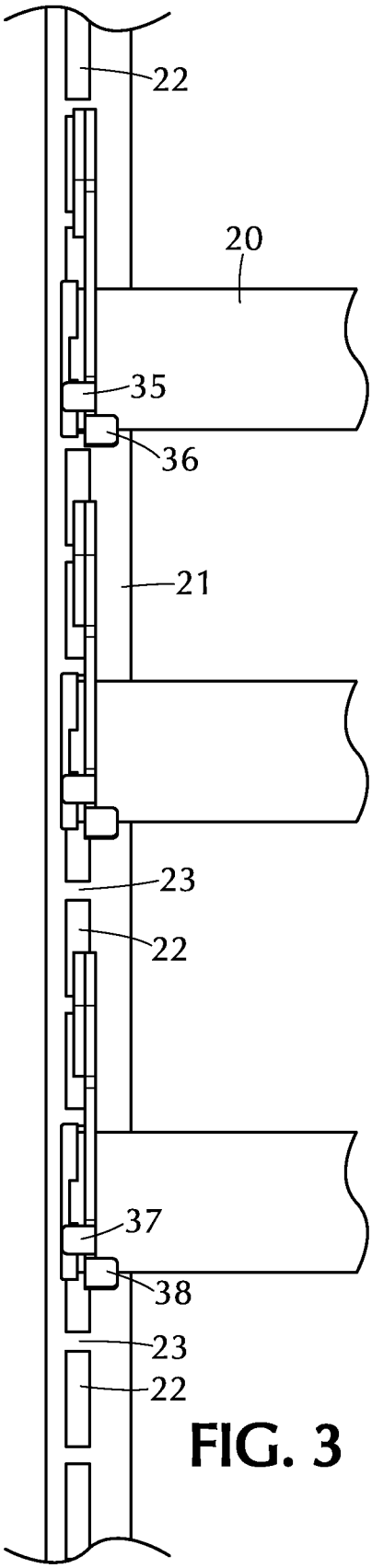
FIG. 3 is a fragmentary front elevational view of a merchandise display arrangement illustrating a plurality of mounting bars supported on an upright.
Figure 13:
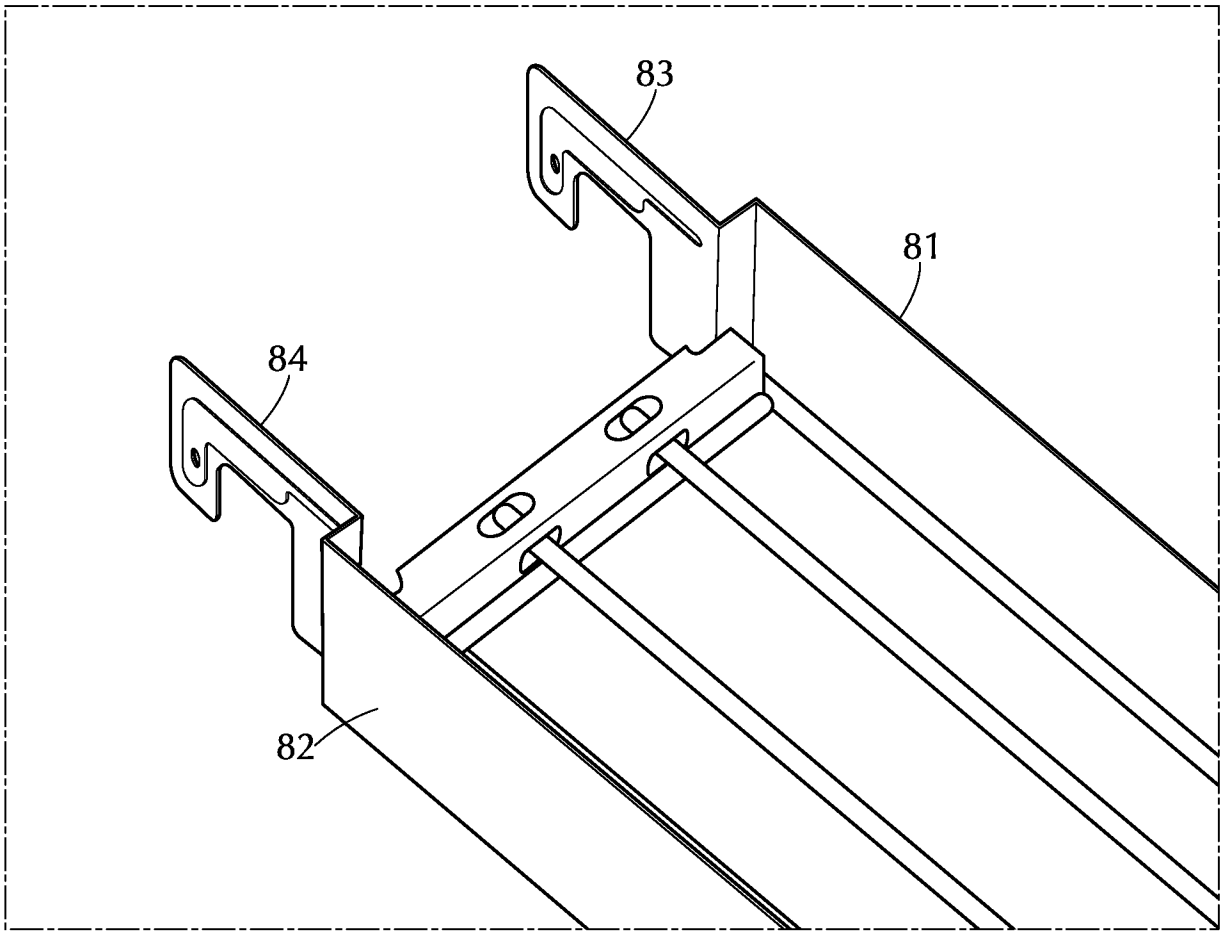
FIG. 13 is a partial orthographic view, from above, illustrating a modified form of tray side wall configuration, provided with offset bar-engaging portions to enable trays to partially overlap the vertical uprights on which their mounting bars are supported.

In FIG. 13, there is shown an alternative form of tray mounting in which the side walls 81, 82 are formed with inwardly offset portions 83, 84 at their back ends, which extend rearward parallel to the front portions of the side walls. The extent of the offset corresponds to all or part of the width of a vertical upright 21 (FIG. 3). This arrangement enables a tray, positioned at one end of a mounting bar, to partially overlap the front of the adjacent upright, by positioning an offset back portion 83, 84 of a side wall 81, 82 close to or against a mounting bracket by which the bar is mounted to a vertical upright. This provides an opportunity to realize a more dense lateral configuration of tray facings since the lateral space otherwise occupied by the vertical uprights can be overlapped and occupied by trays at the end extremities of the mounting bar.

It should be understood, of course, that the specific preferred embodiments of the invention illustrated and described herein are intended to be representative only, and not by way of limitation, as variations may be made therein without departing from the clear teachings of the invention. Accordingly reference should be made to the following appended claims in determining the full scope of the invention.

What is claimed is:

1. A cantilever-mounted product display tray assembly adapted for removable and laterally adjustable mounting on a horizontally disposed display mounting bar of rectangular cross section, which comprises a longitudinally elongated product-supporting bottom platform having a product-retaining barrier mounted at a forward end thereof, a product pusher paddle mounted for guided longitudinal movement on said bottom platform for urging product packages forwardly toward said barrier, laterally spaced-apart rigid side walls extending along opposite lateral sides of said bottom platform, support elements extending laterally between said side walls and said bottom platform adjacent to front and back ends of said bottom platform and serving to join said bottom platform to lower portions of said side walls, each of said side walls being formed at back extremities thereof with a recess of inverted J-shaped configuration, upper portions of said inverted J-shaped recesses forming downwardly opening recess portions with spaced apart front and back edges for the partial reception and close confinement of upper portions of said display mounting bar, lower portions of said inverted J-shaped recesses being formed by downward extensions of said front edges, said downward extensions being positioned to bear against at least lowermost front surface portions of said display mounting bar, lower portions of said side walls extending underneath and rearwardly of said inverted J-shaped recesses and, together with upper rear portions of said side walls, defining rearwardly facing side wall openings communicating with said recesses, said inverted J-shaped recesses being configured to receive said display mounting bar, and back portions of said bottom platform extending underneath and at least partially behind said display mounting bar when said display mounting bar is received in said inverted J-shaped recesses.

2. A cantilever-mounted product display tray assembly according to claim 1, wherein, said J-shaped recesses are configured to receive said display mounting bar having a cross sectional height greater than a cross sectional width thereof by a factor of at least two.

3. A cantilever-mounted product display tray assembly according to claim 1, wherein, a vertical distance between said upper rear portions of said side walls and said rearwardly extending lower portions of said side walls being at least equal to a cross sectional height of said display mounting bar.

4. A cantilever-mounted product display tray assembly according to claim 1, wherein, a rearward projection is formed in each of said side walls at a lower extremity of said downward extension of said front edge, positioned to lie closely underneath a forward portion of a bottom surface of said display mounting bar, when said mounting bar is received in said inverted J-shaped recesses, and said projection is of a length to extend underneath only a fractional portion of said display mounting bar.

5. A cantilever-mounted product display tray assembly according to claim 4, wherein, said upper portions of said inverted J-shaped recesses include back edge portions of a length to extend along only a fractional portion of said display mounting bar.

6. A cantilever-mounted product display tray assembly according to claim 5, wherein, the length of said back edge portions is approximately 20% of the cross sectional height of said display mounting bar.

7. A cantilever-mounted product display tray assembly according to claim 1, wherein, said bottom platform comprises a plurality of laterally spaced, longitudinally extending rod elements, and front and back base members supporting said rod elements at front and back extremities thereof, and said back base member is positioned underneath and at least partially behind said display mounting bar when said display mounting bar is received in said inverted J-shaped recesses.

8. A cantilever-mounted product display tray assembly according to claim 7, wherein, said base members are positioned at front and back extremities of said side walls, and said support elements comprise rod elements fixed to said front and back extremities of said side walls and adjustably engaged with said base members, whereby said side walls may be adjusted laterally with respect to said base elements.

9. A cantilever-mounted product display tray assembly according to claim 7, wherein, said pusher paddle is slidably engaged by said longitudinally extending rod elements, and said back base element is positioned to enable said pusher paddle to be moved rearwardly into contact with said display mounting bar, when said display mounting bar is received in said inverted J-shaped recesses, whereby said display mounting bar functions as a limit stop for said pusher paddle.

10. A cantilever-mounted product display tray assembly according to claim 9, wherein, said pusher paddle comprises a front panel engageable with product items supported on said platform and a flexible back panel connected at upper portions thereof with said front panel and having lower portions normally spaced rearwardly of lower portions of said front panel, and said back panel has mid portions engageable with said display mounting bar when said pusher paddle is moved rearwardly to a position for loading product items onto said platform.

11. A cantilever-mounted product display tray assembly according to claim 5, wherein, said side walls have lower edges, base members are positioned at front and back extremities of said side walls, and said base members have portions extending at least slightly below said side wall lower edges such that said display tray is supported by its base members when placed on a shelf.

12. A cantilever-mounted product display tray assembly adapted for removable and laterally adjustable mounting on a horizontally disposed display mounting bar of rectangular configuration, which comprises a longitudinally elongated product-supporting bottom platform having a product-retaining barrier mounted at a forward end thereof, a product pusher paddle mounted for guided longitudinal movement on said bottom platform for urging product packages forwardly toward said barrier, laterally spaced-apart rigid side walls extending along opposite lateral sides of said bottom platform, support elements extending laterally between said side walls and said bottom platform adjacent to front and back ends of said bottom platform and serving to join said bottom platform to said side walls, each of said side walls being formed at back extremities thereof with a recess of inverted J-shaped configuration, upper portions of said inverted J-shaped recesses forming downwardly opening recess portions with spaced apart front and back edges for the partial reception and close confinement of upper portions of said display mounting bar, lower portions of said inverted J-shaped recesses being formed by downward extensions of said front edges, said downward extensions being positioned to bear against at least lowermost front surface portions of said display mounting bar, lower portions of said side walls extending underneath at least portions of said inverted J-shaped recesses and, together with upper rear portions of said side walls, defining rearwardly facing side wall openings communicating with said recesses, said bottom platform comprises a plurality of laterally spaced, longitudinally extending elements, and front and back base members supporting said longitudinally extending elements at front and back extremities thereof, said back base member being positioned underneath and at least partially behind a front wall of said display mounting bar, when said display mounting bar is received in said inverted J-shaped recesses.

13. A cantilever-mounted product display tray assembly according to claim 12, wherein, said pusher paddle is slidably engaged by said longitudinally extending elements, and said back base element is positioned sufficiently far behind the front wall of said display mounting bar to enable said pusher paddle to be moved rearwardly into contact with said display mounting bar, when said display mounting bar is received in said inverted J-shaped recesses, whereby said display mounting bar functions as a limit stop for said pusher paddle.

14. A cantilever-mounted product display tray assembly according to claim 13, wherein, said pusher paddle comprises a front panel engageable with product items supported on said platform and a flexible back panel connected at upper portions thereof with said front panel and having lower portions normally spaced rearwardly of lower portions of said front panel, said back panel having mid portions engageable with said display mounting bar, when said display mounting bar is received in said recesses, when said pusher paddle is moved rearwardly to a position for loading product items onto said platform.

15. A cantilever-mounted product display tray assembly according to claim 12, wherein, said inverted J-shaped recesses are shaped and sized to receive a said display mounting bar having a rectangular cross section of greater cross sectional height than cross sectional width.

16. A cantilever-mounted product display tray assembly according to claim 15, wherein, said inverted J-shaped recesses are shaped and sized to receive said rectangular display mounting bar having a cross sectional height greater than two times its cross sectional width.

* * * * *